United States Patent [19]

Buschbom et al.

[11] 4,245,968

[45] Jan. 20, 1981

[54] LUBRICATING SYSTEM FOR PUMP AND CONTROL VALVE THEREFOR

[75] Inventors: Floyd E. Buschbom, Long Lake, Minn.; James L. Wirsbinski, Marshfield, Wis.

[73] Assignee: Veda, Inc., Long Lake, Minn.

[21] Appl. No.: 100,709

[22] Filed: Dec. 6, 1979

Related U.S. Application Data

[63] Continuation of Ser. No. 900,190, Apr. 26, 1978, abandoned.

[51] Int. Cl.[3] ..... F04C 29/02; F04C 29/08; F16K 5/22

[52] U.S. Cl. ..... 418/87; 418/100; 137/246; 184/6.16; 184/55 A; 184/85

[58] Field of Search ..... 418/87, 97-100; 137/246, 246.22; 184/55 A, 85, 6.16

[56] References Cited

U.S. PATENT DOCUMENTS

| | | | |
|---|---|---|---|
| 294,315 | 2/1884 | Germeyer et al. | 184/85 |
| 1,899,904 | 2/1933 | Sleeper et al. | 418/100 |
| 1,901,417 | 3/1933 | Sleeper | 418/100 |
| 2,070,151 | 2/1937 | Westin | 418/100 |
| 2,296,081 | 9/1942 | Aspin | 137/246 |
| 2,800,365 | 7/1957 | Hodges | 137/625.47 |
| 2,938,543 | 5/1960 | Johnson | 137/246.22 |
| 2,978,170 | 4/1961 | Ivie | 418/87 |
| 3,265,295 | 8/1966 | Cyr | 418/100 |
| 3,544,010 | 12/1970 | Jurdyc | 239/168 |
| 4,061,273 | 12/1977 | Richardson | 239/172 |
| 4,108,380 | 8/1978 | Richardson | 239/172 |
| 4,116,211 | 9/1978 | Richardson | 137/205 |

FOREIGN PATENT DOCUMENTS

| | | | |
|---|---|---|---|
| 393977 | 6/1933 | United Kingdom | 418/87 |

OTHER PUBLICATIONS

*Van Dale Liquid Manure Spreaders,* Form No. 1-1346, Van Dale, Box 337, Long Lake, Minn.

*Vacuum Manure Spreaders-Feed Easy,* Fleming Manufacturing Co., Box 337, Long Lake, Minn.

*Operator's Manual of Vacuum Liquid Manure Spreaders,* Van Dale, pp. 3 & 4, Van Dale, Box 337, Long Lake, Minn.

*Primary Examiner*—John J. Vrablik

*Attorney, Agent, or Firm*—Burd, Bartz & Gutenkauf

[57] ABSTRACT

A vane air pump is used to selectively supply air under pressure to a tank or evacuate air from the tank. A control valve mounted on the pump has a housing with an air inlet area and an air outlet area. A spool rotatable in the housing to a first position connects the pump and valve passages to supply air under pressure to the tank and a second position connects the pump and valve passages to evacuate air from the tank. A lubricating apparatus having a reservoir for storing oil is connected to the air inlet area of the control valve to draw oil into the control valve and the pump to lubricate the spool of the control valve and bearings and vanes of the pump. An adjustable metering valve controls the flow of oil into the control valve and pump.

20 Claims, 8 Drawing Figures

LUBRICATING SYSTEM FOR PUMP AND CONTROL VALVE THEREFOR

This is a continuation of application Ser. No. 900,190 filed Apr. 26, 1978, now abandoned.

BACKGROUND OF INVENTION

Rotary air pumps are used with material spreading tank machines to supply the tanks with air under pressure and alternatively evacuate the air from the tank. Control valves are used with the pumps to control the flow of air to and from the tanks. The air pumps are provided with lubricating systems for the bearings of the pumps. The lubricating systems have storage containers that allow oil to flow through lines connected to the housings of the pumps to lubricate the bearings of the pumps. The rate of flow of the oil from the containers to the bearings is regulated by manually operated valve structures.

SUMMARY OF INVENTION

The invention is directed to a lubricating apparatus used with a pump to lubricate the moving parts and bearings of the pump. A control valve connected to the inlet and outlet of the pump is used to control the flow of a fluid, as air, to and from a fluid receiver. The lubricating apparatus directs lubricant to the fluid inlet area of the valve so that the inlet fluid carries the lubricant to the pump.

The lubricating apparatus is specifically used with an air pump carrying a control valve to provide lubricant, as oil, to both the control valve and air pump during all phases of the operation of the valve and pump. Lubricant is directed to the air inlet side of the valve so that the air moving through the valve into the pump draws lubricant into the valve and carries the lubricant into the pump. One form of the pump has a rotatable cylinder carrying a plurality of vanes. The vanes slidably mounted on the rotatable cylinder are lubricated by the lubricant carried by the air moving through the pump. The control valve has a spool operable to control the flow of air into and out of the pump. The valve has a housing containing a number of ports operably associated with cavities in the spool, whereby the control valve is operable to selectively evacuate air from a tank or supply air to a tank. The lubricating apparatus has a container or reservoir for storing a lubricant. The lubricant is withdrawn from the container through a tubular means. A means connects the tubular means to the valve to deliver lubricant to the inlet portion of the valve so that air moving through the valve is carried to the pump. The lubricating apparatus includes a metering valve unit operable to regulate the flow of lubricant to the control valve and operable to terminate the flow of lubricant to the control valve.

An object of the invention is to provide a lubricating apparatus for a control valve and gas pump having sliding vanes and bearings which is operable to lubricate the moving parts of the control valve and sliding vanes and bearings of the gas pump. A further object of the invention is to provide a lubricating system for a control valve and gas pump that is operable to lubricate both the valve and the pump during all phases of the operation of the valve and pump. Another object of the invention is to provide a lubricating system for a valve and gas pump that is operable in response to a vacuum pressure to provide for controlled flow of a lubricant to the valve and pump. Yet another object of the invention is to provide a lubricating apparatus with a metering valve unit operable to regulate the rate of flow of a lubricant to a pump and to stop the flow of lubricant to the pump. These and other objects and advantages of the lubricating apparatus are found in the following detailed disclosure.

IN THE DRAWINGS

DESCRIPTION OF PREFERRED EMBODIMENT

Figure 1:
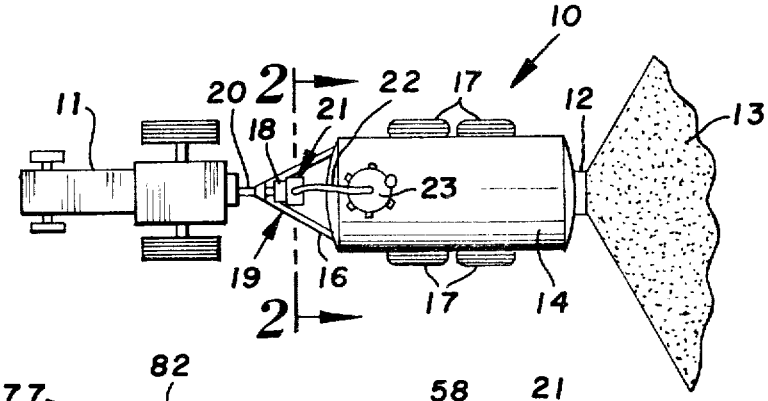
FIG. 1 is a top plan view of a tank material spreader having an air pump and control valve equipped with the lubricating apparatus of the invention connected to a towing vehicle.

Referring to FIG. 1, there is shown a material spreader discharging a liquid material onto a surface, such as the ground. The spreader indicated generally at 10 is towed by a power unit 11, as an agricultural tractor. Spreader 10 has a material discharge assembly 12 operable to direct material under pressure rearwardly of spreader 10 in a swath having a generally horizontal even spread pattern 13. The material can be a mixture of liquid and solid manures, water, or other liquids and semi-liquids. The material is dispensed rearwardly from the spreader in a low profile in a uniform and controlled manner. Discharge assembly 12 is constructed to the discharge structure disclosed in U.S. Pat. No. 3,980,236. Other types of spreader structures can be used to dispense the material onto the desired location.

Spreader 10 is used as part of a liquid manure handling system by hog and poultry producers and dairymen. A vacuum force is used to draw manure through a line into a tank 14. Tank 14 can have a 1,000 to 2,000 or more gallon capacity. The manure in the tank is a combination of liquid and solid substances that are subjected to air under pressure. When material discharge assembly 12 is open, the material in tank 14 being under pressure is discharged rearwardly from tank 14 in the spread pattern 13 onto the location. The following description is directed to the handling of liquid manures with spreader 10. It is understood that other materials, liquids, and semi-solids can be handled with spreader 10.

Tank 14 is an elongated cylindrical container mounted on a rectangular frame 16. Two pairs of tandem wheels 17 are connected to the central portion of the frame 16 with an under carriage through a walking beam suspension. Frame 16 has a forwardly converging A-framed tongue 17 connected to the draw bar of power unit 11. An air pump indicated generally at 19 is mounted on the forward portion of tongue 18. A conventional PTO drive 20 drivably connects power unit 11 and pump 19. Pump 19 is operable to move a gas, as air. The following description is directed to air as the substance being pumped by pump 19. Other gases can be handled by pump 19.

A control valve indicated generally at 21 is mounted on pump 19. Valve 21 is connected to the tank via a line or hose 22. The hose 22 is joined to a removable cover 23. Cover 23 is mounted on a dome on the forward top portion of tank 14. The details of the dome and cover structure are shown in U.S. Pat. No. 4,061,273. Valve 21 is operable to selectively (1) connect the inlet or vacuum port of the pump to the tank, whereby the pump withdraws air from the tank, and (2) connect the outlet port of the pump to the tank, whereby air under pressure is supplied to the tank.

Figure 2:
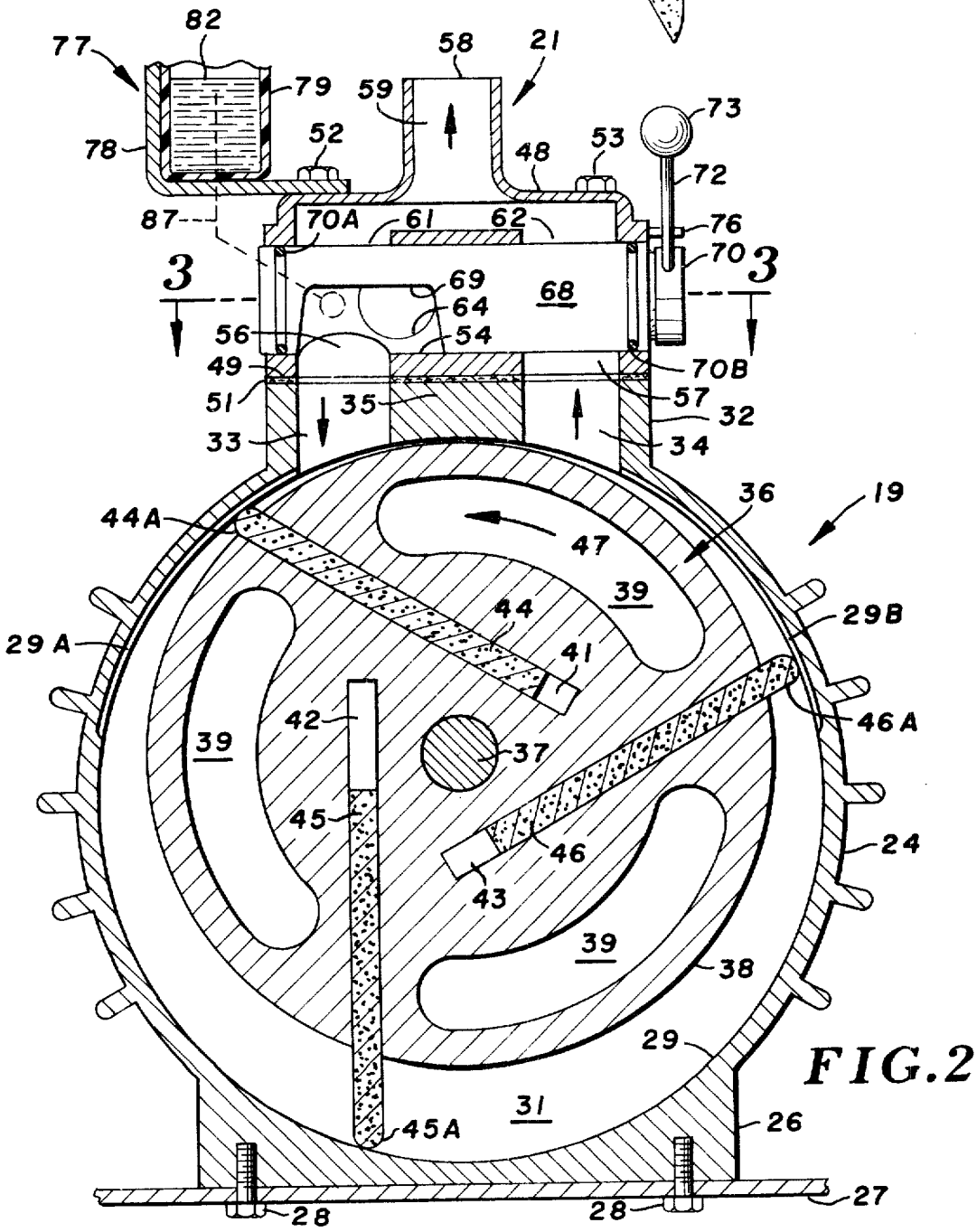
FIG. 2 is an enlarged sectional view taken along the line 2—2 of FIG. 1.

Referring to FIG. 2, pump 19 has a cylindrical housing or casing 24 enclosing a cylindrical chamber. End plates (not shown) are mounted on opposite ends of housing 24. The bottom of housing 24 has a base 26 supported on a cross plate 27. Cross plate 27 is secured to tongue 18. A plurality of bolts 28 mount base 26 to plate 27. Housing 24 has a cylindrical inside wall 29 surrounding chamber 31. A head or upright block 32 is integral with the top of housing 24. Block 32 has an inlet air passage 33 open to the top of chamber 31 and an air outlet passage 34 open to chamber 31. Passages 33 and 34 are circumferentially separated from each other with a wall 35. The inlet side of wall 29 has an arcuate groove 29A to allow air to flow down into chamber 31. The outlet side of wall 29 has an arcuate groove 29B permitting air to flow from chamber 31 to outlet passage 34.

A cylindrical rotor indicated generally at 36 is located in chamber 31. Rotor 36 is mounted on a horizontal shaft 37. Shaft 37 is rotatably mounted on the end plates with suitable bearings (not shown). One end of the shaft 37 is connected to the PTO drive 20. Shaft 37 is located above the longitudinal center of chamber 31 so that the upper portion of the outer cylindrical surface 38 of rotor 36 is in close proximity to wall 35. The diameter of rotor 36 is smaller than the diameter of chamber 31, thereby spacing the outer cylindrical surface 38 from the inside wall 29 of housing 24. The space between the surface 38 and the wall 29 increases from inlet passage 33 to the bottom of chamber 31 and then decreases from the bottom to outlet passage 34.

Rotor 36 has three circumferentially spaced non-radial slots 41, 42, and 43. Each slot extends from the outer cylindrical surface 38 past the center line of the rotor 36 along a cord line of rotor 36.

Movable vanes 44, 45, and 46 are slidably disposed in slots 41, 42, and 43. Vanes 44, 45, and 46 are flat blade-like members having flat side walls that engage the flat walls of rotor 36 forming slots 41, 42, and 43. The outer ends 44A, 45A, and 46A of each of the vanes are round or have a semi-circular shape. The ends 44A, 45A, and 46A engage the cylindrical inside wall 29. Vanes 44, 45, and 46 are flat members made of material, such as wood, fiberboard, or hard plastic. The slots 41, 42, and 43 locate vanes 44, 45, and 46 in a forward inclined direction. Rotation of the rotor 36 is indicated by the arrow 47 in FIG. 2.

Referring to FIGS. 2-6, control valve 21 has a housing 48 provided with a flat bottom 49. A gasket or seal 51 is interposed betweem bottom 49 and the top of block 32. Bolts 52 and 53 extended through vertical holes in housing 48 are threaded into block 32 to secure housing 48 to block 32.

Housing 48 has a longitudinal cylindrical bore 54. A first or inlet port 56 open to bore 54 is aligned with inlet passage 33. A second or outlet port 57 open to bore 54 is aligned with outlet passage 34. Ports 56 and 57 provide passages for the flow of air from bore 54 into and out of pump 19. The top of housing 48 has an upright tubular extension or nipple 58 having a passage 59. Passage 59 is in communication with a pair of ports 61 and 62 open to the top of opposite ends of bore 54.

Figure 3:
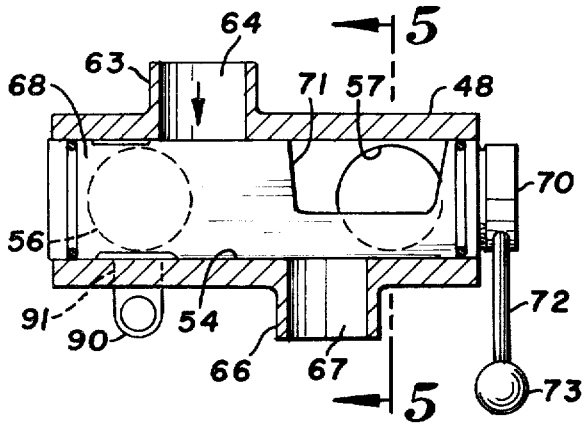
FIG. 3 is a sectional view taken along the line 3—3 of FIG. 2 with the valve spool in the pressure position.
Figure 4:
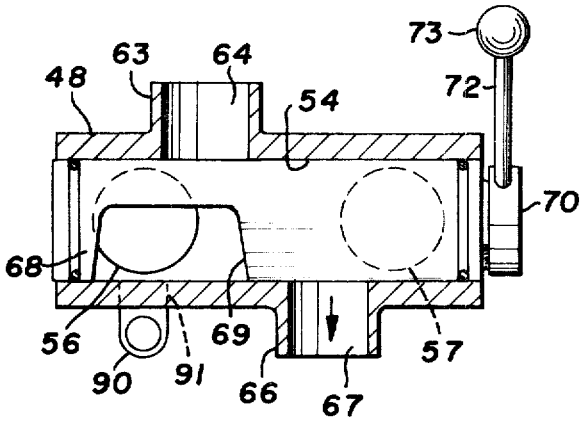
FIG. 4 is a sectional view similar to FIG. 3 showing the valve spool in the vacuum position.

Referring to FIGS. 3 and 4, one side of housing 48 has a first side boss 63 having a side port 64 open to bore 54. The opposite side of housing 48 has a second boss 66 having a side port 67 open to bore 54. Bosses 63 and 66 are located on opposite sides of the transverse center of housing 48.

Figure 5:
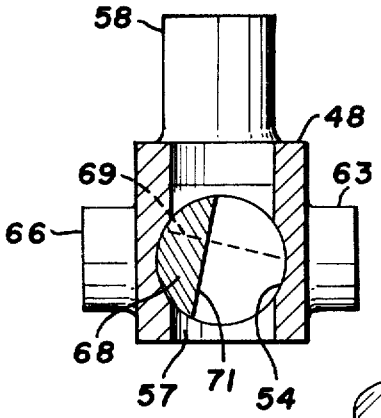
FIG. 5 is a sectional view taken along the line 5—5 of FIG. 3.
Figure 6:
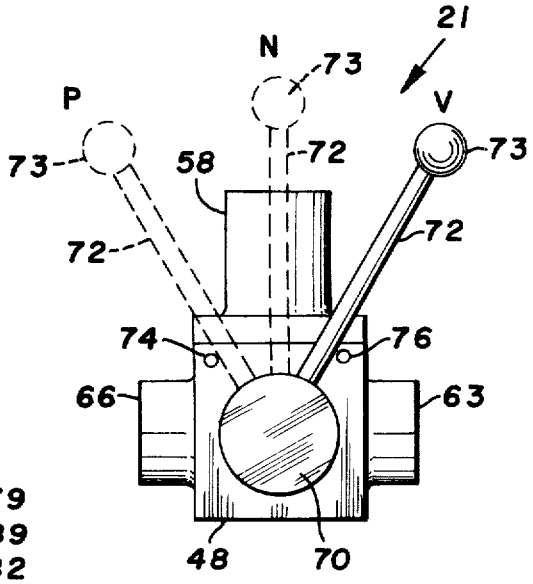
FIG. 6 is an end view of the right end of the control valve shown in FIG. 2.

A valving member or rotatable spool 68 is located in bore 54. Spool 68 has a cylindrical outer surface located in a snug surface engagement with the cylindrical inside wall of housing 48 forming bore 54. The adjacent surfaces of spool 68 and inside wall of housing 48 are lubricated to facilitate manual rotation of spool 68. Annular seals 70A and 70B surround opposite ends of spool 68 and engage the inside wall of housing 48. As shown in FIGS. 2 and 4, spool 68 has a first cavity 69 aligned with ports 56 and 64 to provide a passage for the flow of air through bore 54 into pump 19. The opposite end of spool 68 has a second cavity 71 aligned with the ports 57, 62, and 67. As shown in FIG. 5, cavities 69 and 71 are in an approximate right angle relationship with each other. Each cavity 69 and 71 has a depth greater than the radius of spool 68 and extends across the transverse dimensions of spool 68.

As shown in FIGS. 2, 3, 4, and 7, the right end of spool 68 has a cylindrical head 70. A radial arm 72 is secured to head 70. A knob 73 is mounted on the outer end of arm 72. Arm 72 is used as a lever to rotate the spool 68 between a pressure position P, neutral position N, and vacuum position V. A first stop pin 74 mounted on housing 48 engages arm 72 to determine the pressure position of spool 68. A second stop pin 76 mounted on housing 48 engages arm 72 to determine the vacuum position of the spool 68. When arm 72 is in the straight up or vertical position, spool 68 is in the neutral position.

A valve and pump lubricating apparatus indicated generally at 77 is used to provide a lubricant, as oil, to valve 21 and air pump 19. The oil is introduced into the air moving through bore 54 and carried by the air into the inlet side of pump 19. The oil lubricates the vanes 44, 45, and 46 in slots 41, 42, and 43 and the outer ends 44A, 45A, and 46A of the vanes that engage the inside cylindrical surface 29 of housing 24 and the bearings rotatably supporting shaft 37. A right-angle bracket 78 mounted on housing 48 with bolts 52 is used to support lubricating apparatus 77. Lubricating apparatus 77 has an upright cylindrical container or reservoir 79 having an open top closed with a cap 81. Container 79 is used to store a lubricant, such as oil. A band 83 surrounding container 79 mounts container 79 on bracket 78.

A metering valve unit 84 controls the flow of lubricant from container 79 to the inlet side of bore 54. A first or inlet elbow 86 mounted on top of unit 84 is connected to a tube 87. A tubular connector 88 joins tube 87 to an upper portion of container 79. A short tube 89 located inside container 79 extends from connector 88 to the bottom of container 79 to carry the lubricant to line 87. A second outlet elbow 90 attached to the bottom of unit 84 is threaded into a hole 91 in the air inlet side of valve housing 48. Hole 91 is open to the side of bore 54 so that the vacuum force in the spool cavity 69 draws the lubricant into the valve bore 54 and the inlet of pump 19. This lubricates both the valve spool 68, the pump vanes 44, 45, and 46, and pump bearings.

Figure 8:
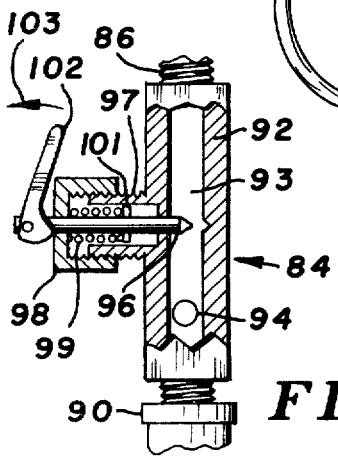
FIG. 8 is an enlarged sectional view taken along line 8—8 of FIG. 7.
Figure 7:
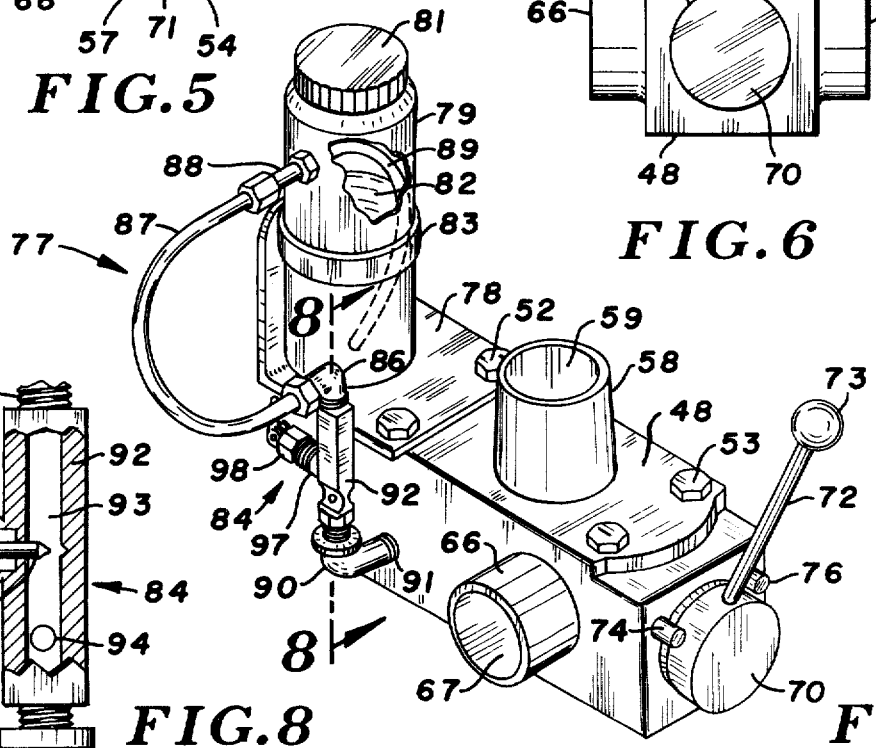
FIG. 7 is a perspective view of the control valve carrying the lubricating apparatus for the valve and air pump.

As shown in FIG. 8, metering valve unit 84 has an upright body 92 containing an upright passage 93. The lower end of body 92 has a viewing window 94 to permit the operator to visually check the flow of lubricant through unit 84. The flow of lubricant through passage 93 is controlled by an adjustable needle 96. Needle 96 has a forward pointed end that extends into passage 93 restricting the size of passage 93 and thereby limiting the flow of lubricant through passage 93. Needle 96 is located in a side boss 97 attached to body 92. An adjustable cap 98 is threaded onto boss 97. A compression spring 99 located within cap 98 biases needle 96 to a closed position. A stop projection 101 on needle 96 engages spring 99 so that spring 99 biases needle 96 in the forward or closed position. The outer end of needle 96 is connected to an over-center lever 102. The lever 102 can be moved to a closed position in the direction of the arrow 103, whereby the spring 99 will bias the needle 96 to the closed position. Cap 98 is adjustable on boss 97 to control the position of needle 96. Cap 98 is used to regulate the flow of a lubricant through passage 93. The over-center lever 102 is used to turn the valve unit 84 on and off.

In use, tractor 11 being connected to pump 19 with the PTO drive 20 rotates rotor 36 in the direction of the arrow 47. Vanes 44, 45, and 46 being in engagement with the cylindrical inside surface 29 and housing 24 move the air in chamber 31 out outlet 34. The air is drawn into the chamber 31 through inlet port 56. When spool 68 is located in the pressure position, as shown in FIGS. 2 and 3, the air from the atmosphere will be drawn through port 63 and into bore 54 and directed by the spool cavity 69 to air inlet port 56. The air under pressure is delivered to exit port 57 and directed by spool cavity 71 to the tank via exit port 62 and passage 59. This directs the air under pressure to the tank 14. When the metering valve unit 84 is in the on position, as shown in FIG. 8, the air in the spool cavity 69 will be under vacuum pressure as it is being drawn into the pump. This creates a suction force in the metering passage 93 to draw oil up from the reservoir 79 into the line 87. The needle 96 regulates the flow of the oil through the passage 93, so that a controlled amount of oil is allowed to be delivered to valve 21. The air in passage 33 breaks the oil into particles and carries the oil particles into pump chamber 31. The oil lubricates the outer ends of the vanes, the sides of the vanes located in the slots 41, 42, and 43, and the pump bearings. Some of the oil passes through the outlet passage 34 and lubricates the outlet side of spool 68.

Valve unit 84 can be turned off to stop the flow of lubricant to valve 21 and pump 19. This is done by moving the lever 102 to the out position so that the spring 99 will move needle 96 to a closed position.

When spool 68 is moved to the vacuum position, as shown in FIG. 4, the spool cavity 69 is aligned with the inlet port 56 and the top port 61. The air is drawn through passage 59 into the pump 19. Lubricant is fed into the side of spool cavity 69 so that pump 19 is provided with lubricant when spool 68 is in the vacuum position. The second spool cavity aligns the outlet port 57 with the port 67 so that the air is discharged into the atmosphere. The port 62 is closed by spool 68.

While there has been shown and described the preferred embodiment of the invention, it is understood that changes in the use, structures, materials, and arrangement of structures and parts may be made by those skilled in the art without departing from the invention.

The embodiments of the invention in which an exclusive property or privilege is claimed are defined as follows:

1. A lubricating apparatus for a pump having a gas inlet passage, a gas outlet passage, and means operable to move gas from the inlet passage to the outlet passage, and a manually operable gas control valve having a housing containing a cylindrical bore, an inlet port in communication with the bore and inlet passage of the pump for carrying gas under vacuum pressure, an outlet means in communication with the bore and outlet passage of the pump for carrying gas under pressure, and valving means located in the bore, said valving means having a surface in snug engagement with the housing walls defining said bore operable to control the flow of gas through the housing comprising: a container mounted on the housing for storing lubricant, said container having an upper portion located above the stored liquid in the container, first means connected to the upper portion of the container and extended down into said lubricant for carrying lubricant from the container, and second means connecting the first means to the housing to carry lubricant to the bore adjacent the inlet port to lubricate the valve means located in the bore for manual operation thereof, said lubricant being withdrawn by the vacuum pressure in the bore from the container and carried by the first means and second means to the bore whereby gas moving through the bore and into the inlet port carries lubricant to the pump to lubricate the pump.

2. The apparatus of claim 1 wherein: the means to regulate the flow of lubricant includes a needle, means to adjust the position of the needle to adjust the rate of flow of lubricant to the bore, and viewing means for visually observing the rate of flow of lubricant.

3. The apparatus of claim 1 wherein: the second means includes means to regulate the rate of flow of lubricant to the bore.

4. The apparatus of claim 3 wherein: the means to regulate the flow of lubricant includes a movable member, and means to adjust the position of the movable member to adjust the rate of flow of lubricant to the bore.

5. The apparatus of claim 4 including: means to move the movable member to a position to stop the flow of lubricant to the bore.

6. The apparatus of claim 1 wherein: the second means includes a metering device to regulate the flow of lubricant to the bore, said metering device having a body with a lubricant passage, and adjustable needle with a pointed end extended into the passage to adjustably restrict the size of the passage and thereby control the flow of lubricant through said passage.

7. The apparatus of claim 6 including: means to move the needle to a position to stop the flow of lubricant to said passage.

8. A gas control and pump apparatus comprising: a pump operable to move gas, a manually operable valve means for controlling the flow of gas into and out of the pump, said valve means including a valve housing mounted on the pump with an inlet port open to the pump to admit gas into the pump, said inlet port carrying gas under vacuum pressure to the pump, and lubricating means for supplying lubricant to the valve means to lubricate the valve means for manual operation thereof and the pump, said lubricating means including a closed container mounted on the valve housing containing a supply of lubricants, first means connected to the container for carrying lubricant from the container, second means connected to the first means for delivering lubricant to the valve means, said first means including a first tube located in the container extended from the upper portion of the container into the bottom of the container and a second tube outside the container connected at one end to the first tube at the upper portion of the container, said second means including a metering device to regulate the flow of lubricant to the valve means, said metering device being connected to the other end of the second tube and having a body with a lubricating passage, an adjustable needle with a pointed end extended into the passage to adjustably restrict the size of the passage, and a viewing window on said body for inspection of the flow of lubricant, said second means connected to the valve housing adjacent the inlet port whereby said gas under vacuum pressure withdraws lubricant from the container, said lubricant being carried by the first and second tube means to the metering device which allows a controlled amount of lubricant to flow to said valve means, said lubricant lubricating the valve means and the pump.

9. The apparatus of claim 8 including: means to move the needle to a position to stop the flow of lubricant through the metering device.

10. A gas control and pumping apparatus comprising: a pump means including a housing having an inside wall surrounding a chamber, a gas inlet passage open to the chamber, and a gas outlet passage open to the chamber; a rotor located in the chamber rotatably mounted on the housing, a plurality of vanes associated with the rotor and engageable with the inside wall operable to move gas through the chamber from the inlet passage to the outlet passage on rotation of the motor; manually operable valve means mounted on the housing having a valve outlet passage for selectively controlling the flow of gas to and from the valve outlet passage, said valve means including a body having a cylindrical inside wall defining a cylindrical bore, a gas inlet port open to the bore and inlet passage, said inlet port and inlet passage carrying gas under vacuum pressure from the bore to the chamber of the housing of the pump means, a gas outlet port open to the bore and gas outlet passage, said outlet port and outlet passage carrying gas under pressure from the chamber of the housing of the pump means to the bore and valve outlet passage, a rotatable spool located in the bore for controlling the flow of gas in the valve outlet passage; said spool having a cylindrical outer surface located in a snug surface engagement with the cylindrical inside wall of the body defining the bore, and lubricating means mounted on the body for supplying lubricant to the bore adjacent the gas inlet port, said lubricating means including a container for storing lubricant, said container having an upper portion located above the lubricant stored in the container, tubular means connected to the upper portion of the container and extended down into said lubricant, lubricant control means connected to the tubular means and body for controlling the flow of lubricant to the valve bore, said lubricant being withdrawn by the vacuum pressure in the bore from the container and carried by the tubular means to the lubricant control means which allows a controlled amount of lubricant to flow into the bore, said lubricant lubricating the cylindrical outer surface of the spool and inside wall of the body and vanes of the pump means.

11. The structure of claim 10 wherein: the rotor has a plurality of slots, each of said vanes being a generally flat member slidably located in a slot, each member having an outer edge engageable with the inside wall of the housing.

12. The structure of claim 10 wherein: the lubricant control means includes valve means having a movable member to adjust the rate of flow of lubricant to the bore.

13. The apparatus of claim 12 including: means to move the movable member to a position to stop the flow of lubricant to the bore.

14. The structure of claim 10 wherein: the tubular means includes a first tube located in the container and extended to the bottom of the container, and a second tube for carrying lubricant from the container to the lubricant control means.

15. The structure of claim 7 wherein: the lubricant control means includes means to regulate the rate of flow of lubricant to the bore.

16. A gas control and pumping apparatus comprising: a pump including a housing having a pump chamber, a gas inlet passage means open to the pump chamber, and gas outlet passage means open to the pump chamber; means located in the pump chamber operable to move gas into the inlet passage means and out of the outlet passage means; manually operable valve means mounted on the housing for controlling gas to and from the pump, said valve means having a body having a cylindrical bore, a gas inlet port open to the bore and inlet passage means, said inlet port and inlet passage means carrying gas under vacuum pressure from the bore to the chamber of the housing of the pump, a gas outlet port open to the bore and the gas outlet passage means, said outlet port and outlet passage means carrying gas under pressure from the chamber of the housing of the pump to the bore and valve outlet passage, rotatable spool means located in the bore for controlling the flow of gas in the outlet passage, said spool means having a cylindrical outer surface located in a snug surface engagement with the cylindrical inside wall of the body defining the bore and lubricating means for supplying lubricant to the gas inlet passage means, said lubricating means including a container for storing lubricant, said container having an upper portion located above the lubricant stored in the container, means connected to the upper portion of the container and extended into said lubricant, lubricant control means connected to the means for carrying lubricant for controlling the flow of lubricant to the bore, said lubricant being withdrawn by the vacuum pressure in the container and carried by the means for carrying lubricant to the lubricant control means which allows a controlled amount of lubricant to flow into the bore, said lubricant lubricating the cylindrical outer surface of the spool means and inside wall of the body and the pump chamber.

17. The structure of claim 16 wherein: the means for carrying lubricant includes a first tube located in the container and extended to the bottom of the container and a second tube for carrying lubricant from the container to the lubricant control means.

18. The structure of claim 16 wherein: the lubricant control means includes valve means to regulate the rate of flow of lubricant to the bore.

19. The apparatus of claim 18 wherein: the valve means includes a movable member, and means to adjust the position of the movable member to adjust the rate of flow of lubricant to the bore.

20. The apparatus of claim 19 including: means to move the movable member to a position to stop the flow of lubricant to the bore.

* * * * *